US006196425B1

(12) United States Patent
Fielding et al.

(10) Patent No.: US 6,196,425 B1
(45) Date of Patent: Mar. 6, 2001

(54) PORTABLE LIQUID CONTAINER SHOWING IMPROVED POURING CAPABILITIES

(76) Inventors: Allan Fielding, 2 Old Hall Road, Batley, West Yorkshire, WF17 OAX (GB); Douglas Peter Burnham, Woodlands, Scotchman Lane, Morely, Leeds, LS27 OBX (GB)

( * ) Notice: Subject to any disclaimer, the term of this patent is extended or adjusted under 35 U.S.C. 154(b) by 0 days.

(21) Appl. No.: 09/465,010

(22) Filed: Dec. 16, 1999

(30) Foreign Application Priority Data

Dec. 18, 1998 (GB) ..... 98 27899

(51) Int. Cl.[7] ..... B65D 83/00; B67D 3/00; B67D 5/06

(52) U.S. Cl. ..... 222/468; 222/538; 222/479

(58) Field of Search ..... 222/538, 530, 222/468, 481.5, 479, 478

(56) References Cited

U.S. PATENT DOCUMENTS

| | | | | |
|---|---|---|---|---|
| D. 353,541 | * | 12/1994 | Rogler et al. | D9/520 |
| 3,173,587 | * | 3/1965 | Stearns | 222/479 |
| 3,251,514 | * | 5/1966 | Speicher | 222/479 |
| 3,410,459 | * | 11/1968 | Conley | 222/497 |
| 4,804,119 | | 2/1989 | Goodall | 222/468 |
| 4,971,230 | * | 11/1990 | Clubb et al. | 222/468 |
| 5,107,909 | * | 4/1992 | Donovan | 141/296 |
| 5,538,165 | * | 7/1996 | Frohn | 222/479 |
| 5,746,358 | * | 5/1998 | Crosby | 222/479 |

FOREIGN PATENT DOCUMENTS

| | | |
|---|---|---|
| 295 13 404 U | 12/1995 | (DE) . |
| 1 010 628 | 6/2000 | (EP) . |
| 2 747 648 | 10/1997 | (FR) . |

* cited by examiner

*Primary Examiner*—Kevin Shaver
*Assistant Examiner*—David A. Bonderer
(74) *Attorney, Agent, or Firm*—Arent Fox Kintner Plotkin & Kahn PLLC

(57) ABSTRACT

The invention concerns portable liquid containers with improved pouring capabilities. Particularly, there is disclosed a container comprising a body region (1) a hollow handle (3) with first and second ends (4, 5), an outlet spout (6) which communicates with both the body region (1) and the first end of the handle (3) and an elongate pouring tube (2) firmly located and fixed in position relative to the outlet spout (6). The pouring tube (2) has a first end (23) via which the interior of the pouring tube (2) directly communicates with the body region (1) and a second end from which, in use, liquid is dispensed. According to the invention, the interior of the pouring tube (2) forms a first passageway for the exit of liquid from the container, and a second passageway for allowing air to enter into the container is formed by an air gap (x) defined between a second portion (22) of the outer surrounding surface of the pouring tube (2) and the spout (6), air entering the container to replace displaced water, flowing into the air gap (x) and then into handle (3) before entering the body region (1).

16 Claims, 5 Drawing Sheets

PORTABLE LIQUID CONTAINER SHOWING IMPROVED POURING CAPABILITIES

Figure 1:
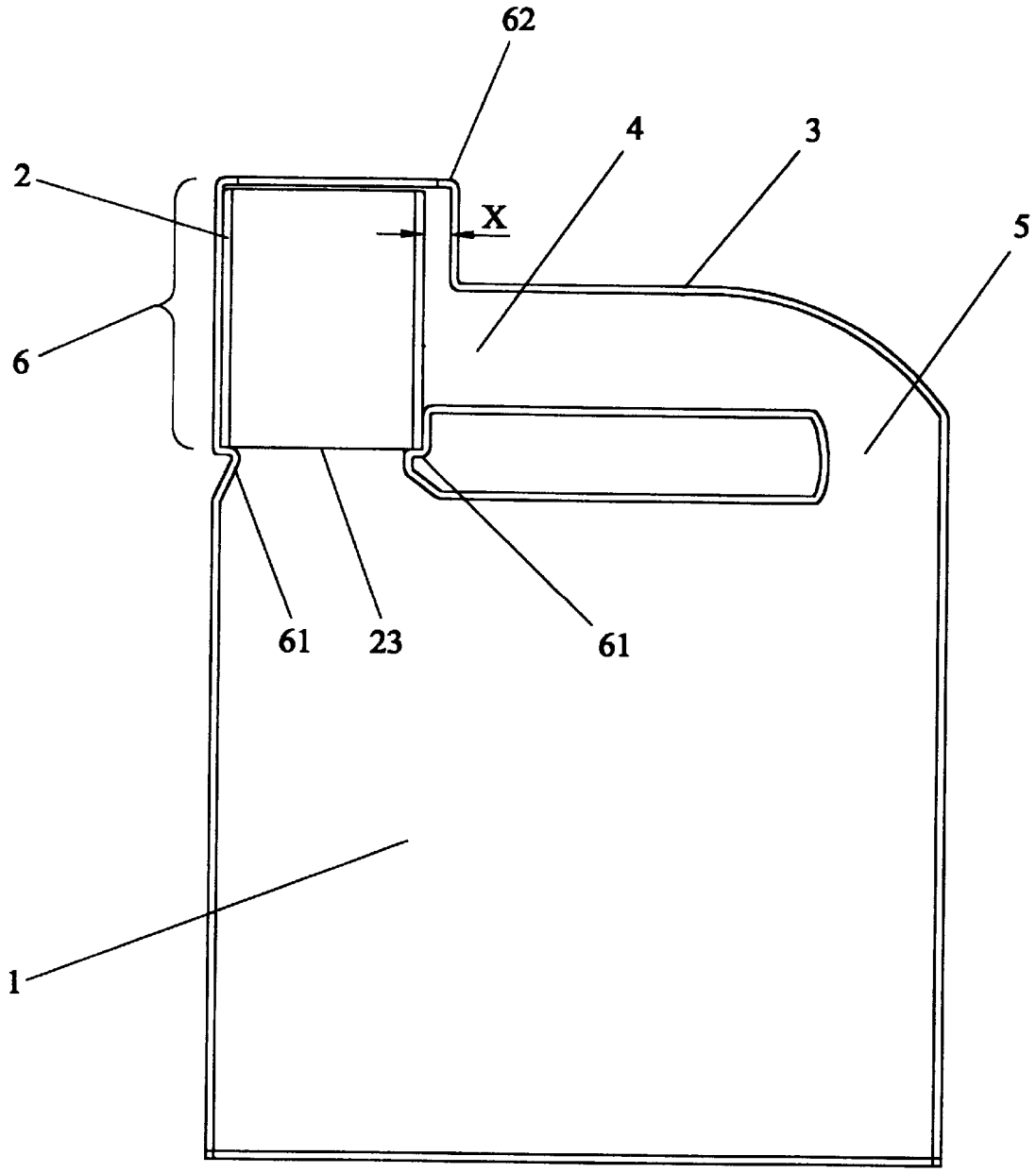

The invention relates to portable liquid containers which, in use, exhibit improved pouring characteristics.

Classical portable liquid containers comprising a single spout through which the liquid exits invariably exhibit turbulent pouring characteristics. This is due to the liquid completely filling the spout on pouring, and the inefficient mode in which such containers are vented to the exterior thereby rendering them unable to equalise the pressure inside with the external atmospheric pressure. Turbulent flow is a main cause of liquid spillage and, where the liquids in question are hazardous chemicals, this may place the user under potentially dangerous conditions. With a view to reducing this problem users often try holding the container at an angle at which the liquid does not entirely block the spout, such that air may enter in a counter-flow direction to the exiting liquid, thereby equalising the pressure inside with that outside the container. Such an angle however will tend to be unsatisfactorily small and result in extended pouring periods.

Alternative methods of circumventing turbulent flow characteristics from liquid containers as described above have been previously suggested. Such examples generally rely upon introducing some means for letting air into the container using a type of air duct design. The example given in GB 1329471 describes a complex pouring tube which is both extendible and retractable and arranged to be centrally mounted within an outlet spout of a container and spaced therefrom by means of four spacers to provide a continuous air passageway between the spout and the pouring tube. The air passageway formed between spout and pouring tube is sealed from a liquid outlet hole of a liquid holding receptacle portion of the container and leads instead into a hollow handle region formed on one side of the container. As the container is tilted to pour, air is channelled by the passageway and the handle to enter the receptacle portion by a first route whilst the liquid is poured out via a second route comprising the outlet hole of the receptacle portion and the interior of the pouring tube itself.

Whilst the arrangement described in the above document is a commercially successful, it does still exhibit some disadvantages. Firstly, because the tube itself is arranged to extend/retract for improving the container reach, the sealing between the exterior of the pouring tube and the liquid outlet hole of the receptacle portion is quite critical and generally requires a complicated tube formation to achieve satisfactory results. Secondly, having the tube centrally mounted within the pouring spout requires spacers between tube and spout interior to keep the tube in such a central position. Thirdly, it has been observed that when the tube is retracted and a pouring operation carried out at a shallow angle, some of the liquid can in certain circumstances get into the air passageway around the pouring tube and affect its efficiency. Finally, the pouring tube itself and its required spacers are of a relatively complex design due to both the perceived need to mount the tube centrally within the spout and to provide the extension feature. Such complication rules out the use of a simple extruded tube and means that a plastics injection moulding technique needs to be adopted.

With a view to solving or reducing at least one of the problems outlined above, it is an aim of embodiments of the present invention to provide a portable liquid container which displays good flow characteristics achieved by the incorporation of novel and simple modifications which are cheap to produce.

According to a first aspect of the present invention, there is provided a container comprising: a body region, a hollow handle with first and second ends, said second end communicating with said body region, an outlet spout extending above said body region and communicating with both said body region and the first end of said handle, and an elongate pouring tube which is firmly located and fixed in position relative to said outlet spout, the pouring tube comprising a first end via which the interior of the pouring tube directly communicates with the body region and a second end from which, in use, liquid is dispensed such that the interior of the pouring tube forms a first passageway for the exit of the liquid, and such that a first portion of the outer surrounding surface of the pouring tube contacts with a corresponding first portion of the interior wall of the spout and a second passageway is formed by the handle and a region formed by an air gap between a second portion of the outer surrounding surface of the pouring tube and a second portion of the interior wall of the outlet spout to allow air to enter into the body region.

Preferably, the pouring tube is of a substantially uniform transverse cross-section.

The outlet spout may also have a substantially uniform transverse cross-section, but the shape of its cross-section is preferably dissimilar to that of the pouring tube.

Preferably, said first portion of the outer surrounding surface of the pouring tube and the corresponding first portion of the interior wall of the spout form an interference fit with one another.

Preferably, the first and second portions of the outer surrounding surface of the pouring tube when added together substantially form the totality of the outer surrounding surface and the first portion forms a larger proportion of the total outer surface area of the pouring tube than the second portion.

The pouring tube may be an extruded plastics tube.

Where the outlet spout is of generally circular cross-section, the pouring tube preferably has a cross-section which is, in part, of a corresponding circular formation such that the radius of curvature of the outer surrounding surface of the pouring tube in the first portion is substantially the same as the radius of curvature of the interior wall of the outlet spout.

The pouring tube may be held in position by fixing means. The fixing means may comprise adhesive.

The first end of the tube is preferably joined to the base region of the spout by a sealing means which seals the base region of the spout from the body region. The sealing means preferably comprises locating means for locating said first end of the tube at the base region of the outlet spout. The locating means may comprise a ring of material arranged to receive a first end of the pouring tube.

An upper region of the outlet spout may be provided with a top retaining lip for maintaining the pouring tube in position once inserted.

Preferably, the body region of the container may be thin walled and moulded out of a tough, liquid-resistant material, for example, a suitable synthetic plastic. The material may be coloured. The volume of the body region may be in the range of ½ liter to 30 liter.

The pouring tube may extend beyond the outlet spout so as to itself form an extension which increases the effective pouring length. The invention extends to such pouring tubes when sold separately from containers.

The outlet spout is preferably formed by a neck region of the container.

Spout extension means may be provided for increasing the effective length of the pouring tube. The spout extension means may incorporate an integral air passage. The spout extension means may include means for threaded connection with the container.

Figure 2:
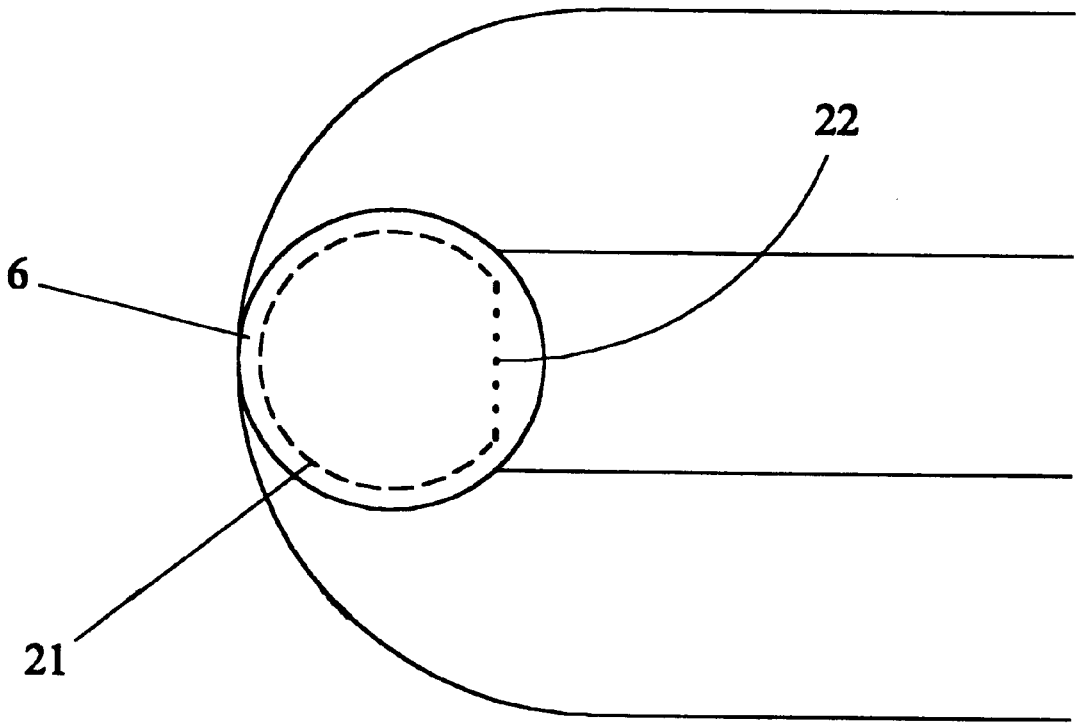

Referring initially to FIGS. 1 and 2, there is shown a container for liquids having an "antiglug" facility. The container comprises a body region 1 in which, in use, liquid is stored, a pouring tube 2, a hollow carrying handle 3 having a first end 4 and a second end 5, and an outlet spout shown generally as reference numeral 6.

The body region 1, handle 3 and outlet spout 6, in the embodiment shown, are a single piece of material formed by a blow/rotational moulding technique and the pouring tube 2 is formed separately possibly by an extrusion method.

Considering FIG. 2, which is a plan view of the container, it can be seen that the pouring tube 2 is a close fit inside the outlet spout 6. More specifically, the pouring tube 2 is an elongate tube of plastics material of substantially uniform cross-section having a first exterior portion 21 [shown by dashes ( - - - )] of it's surface having a first formation and a second portion 22 [shown dotted ( . . . )] of a second formation. The first portion 21 of the surrounding surface of the tube 2 being arranged to contact intimately with an interior surface of the outlet spout 6, and the second portion 22 being arranged so as to deviate from the general shape of the outlet spout 6 and create an air gap X (shown in FIG. 1) between the outer surface of the pouring tube 2 and the inner surface of the spout 6 in a region adjacent to the first end 4 of the hollow handle 3.

From a point of view of dimensions, the first portion 21 of the pouring tube 2 is arranged to have a radius of curvature very closely matching to that of the interior wall of the outlet spout 6 so that the pouring tube 2 is any more detail as they are not crucial to the understanding of the present invention.

Operation of the container of FIGS. 1 and 2 will now be described.

It will be appreciated that body region 1, in use, would contain a liquid such as oil/petrol/chemical for instance. Any cap will of course be removed prior to use and then the container picked up by the handle 3 and tilted in the manner shown in FIG. 3.

Figure 3:
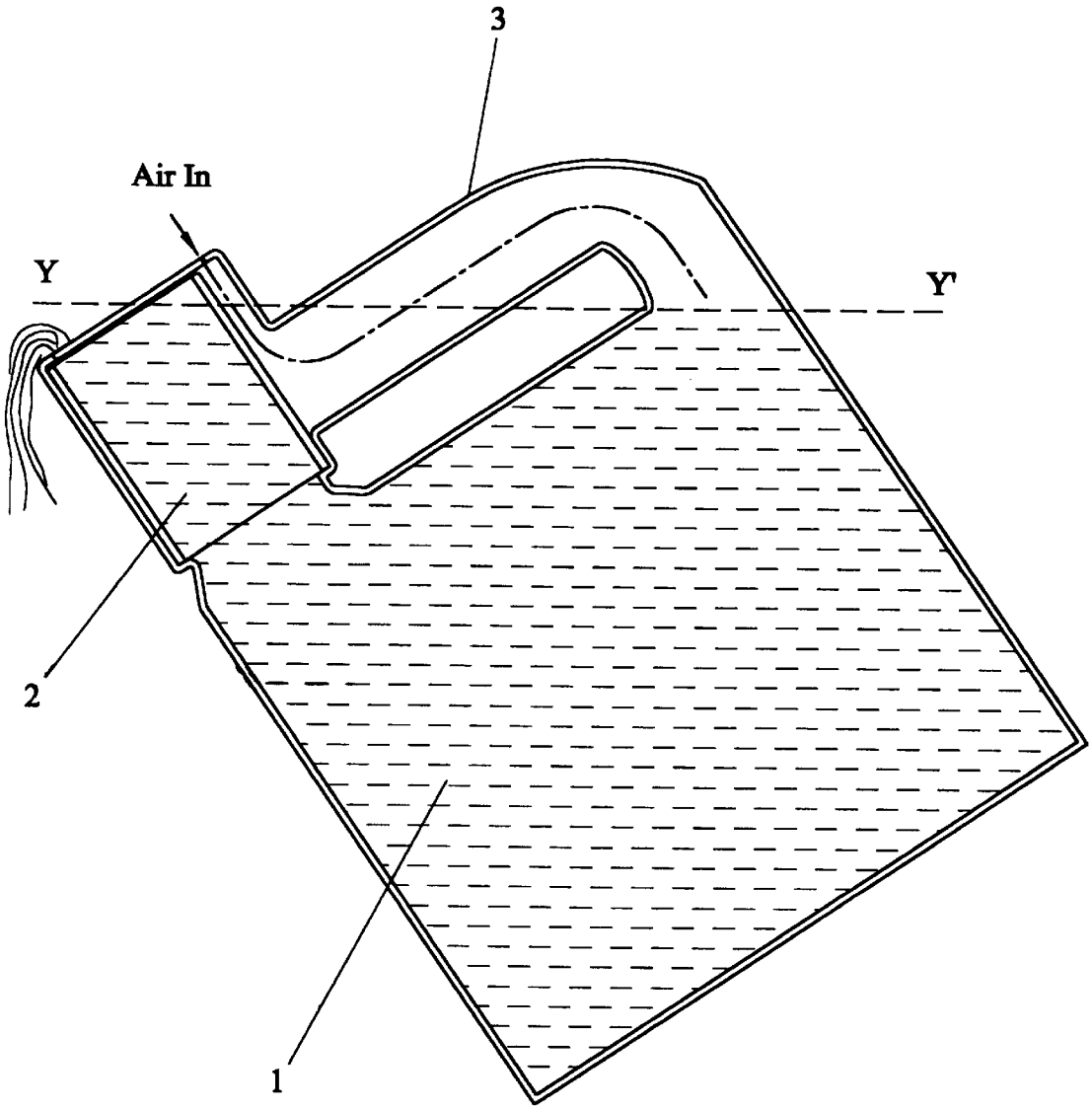

In FIG. 3, liquid in the container is shown by shading, and the general level of the liquid within the container is shown by the horizontal datum line Y–Y'. As can be seen from the Figure, tilting of the container allows liquid to exit via a first passageway formed by the interior of the pouring tube 2 and allows air to enter into the body region 1 of the container via a second passageway shown by the broken chain line ( -. -. -. ) via a second passageway formed by the air gap "X", and the hollow handle 3. As will be appreciated FIG. 3 shows a container which is practically full. Prior art type containers can have the disadvantage that with overfull containers liquid can flow back around any air-ducting arrangements and defeat them. However, with embodiments of the present invention even when the container is overfilled, since the second passageway is arranged, in pouring operations, to always be above the first passageway through which the liquid exits, erratic movements by the person pouring the container should not result in any back-flow of liquid down the second passageway, giving it an advantage over other methods.

Figure 4A:
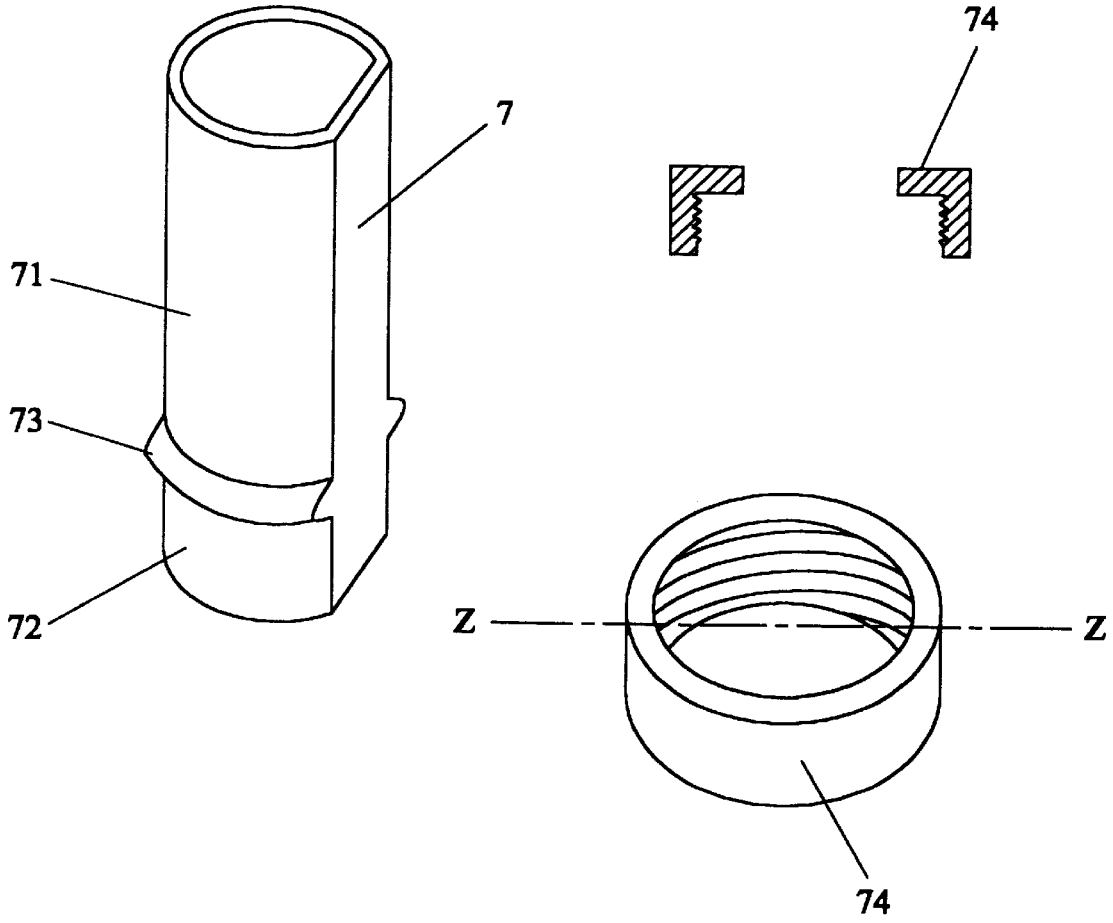
Figure 4B:
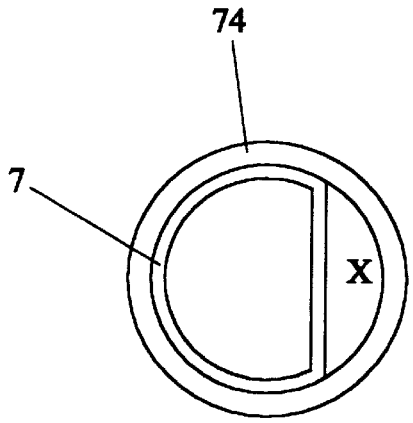

Referring now to FIG. 4A, there is shown a simple spout extender which can be used with containers of the type shown in FIGS. 1 to 3. The spout extender 7 has a neck region 71 and a base region 72, the base region being arranged to be inserted into the top of the pouring tube 2. The base region 72 is arranged to have the same general transverse cross-sectional shape as the pouring tube 2, but may be slightly flared/tapered to form a contact fit with the pouring tube 2. It will be appreciated that whilst only a relatively short neck region 71 is shown, the neck 71 may be of any suitable length and advantageously sufficiently long to cope with whatever a users requirement may be. A shoulder 73 may act as a location means for a collar 74. In use, the extender 7 is inserted so that the base region 72 enters the pouring tube 2 and the shoulder 73 sits on the lip of the spout 6. Collar 74 is then passed over the neck 71 of the extender 7 and screwed onto an externally threaded region of the spout 6 to firmly locate the extender.

It will be appreciated that an alternative arrangement may be used in which an extension tube is used on its own so as to itself form an extended pouring tube type insert. In such cases, the extension would push fit into the outlet spout to form a seal in similar fashion to the pouring tubes already described at or near position 61 to enable the adapting of standard or re-usable containers.

Plan view 4B shows the extender in position.

Figure 4C:
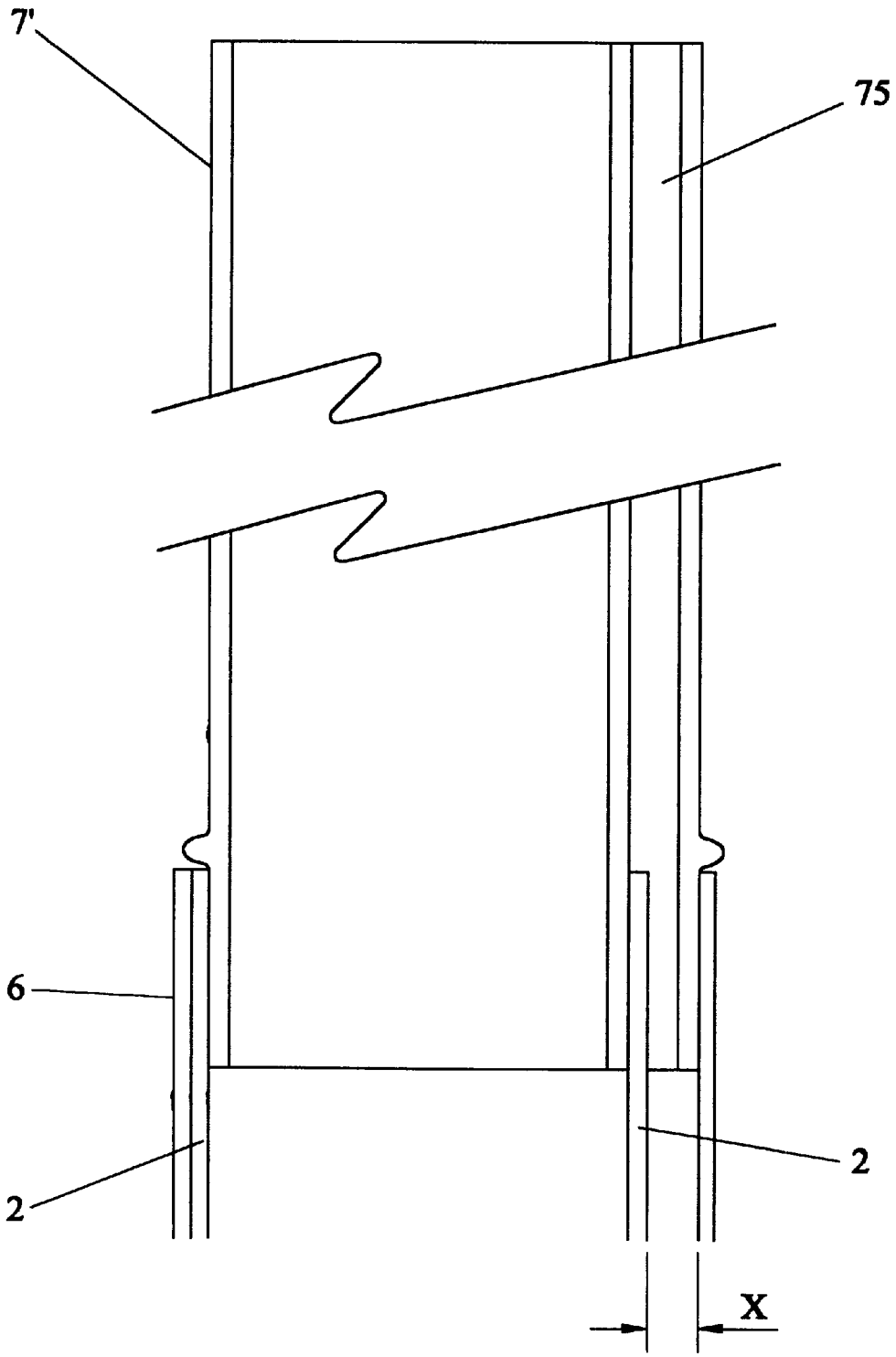

FIG. 4C shows another variant of spout extender 7' having an integral air way 73.

It will be appreciated that various modifications may be made to the container and still be within the scope of the present invention. For instance, the pouring tube 2 may, rather than being an interference fit in the outlet spout 6, be fixed into position by adhesive means, or thermally fused in position. Variations on handle design are of course possible and more than one handle may be provided.

As described above, containers according to embodiments of the present invention exhibit a number of advantages over prior art type containers in that as well as solving the "glugging" problem, they also have a simplified construction in that they do not require spacers or complicated injection moulded pieces. Further, it will be appreciated that by moving the pouring tube away from a centrally located position, extra advantages are achieved and that the simple formation of the tube lends itself to common extrusion techniques.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A container comprising:

a body region (1), a hollow handle (3) with first and second ends (4, 5), said second end (5) communicating with said body region (1), an outlet spout (6) extending above said body region (1) and communicating with both said body region (1) and the first end (4) of said handle (3), and an elongate pouring tube (2) which is firmly located and fixed in position relative to said outlet spout (6), the pouring tube (2) comprising a first end (23) via which the interior of the pouring tube (2) directly communicates with the body region (1) and a second end from which, in use, liquid is dispensed such that the interior of the pouring tube (2) forms a first passageway for the exit of the liquid, and such that a first portion (21) of an outer surrounding surface of the pouring tube (2) contacts with a corresponding first portion of an interior wall of the spout (6) and a second passageway is formed by the handle (3) and a region formed by an air gap (x) between a second portion (22) of the outer surrounding surface of the pouring tube (2) and a second portion of the interior wall of the outlet spout (6) to allow air to enter into the body region (1).

2. A container according to claim 1, wherein the pouring tube (2) is of a substantially uniform transverse cross-section throughout it's length.

3. A container according to claim 2, wherein the outlet spout (6) has a substantially uniform transverse cross-section throughout it's length, but the shape of it's cross-section is dissimilar to that of the pouring tube (2).

4. A container according to claim 1, wherein said first portion (21) of the outer surrounding surface of the pouring tube (2) and the corresponding first portion of the interior wall of the spout (6) form an interference fit with another.

5. A container according to claim 1, wherein the first and second portions of the outer surrounding surface of the pouring tube (2) when added together substantially form the totality of an outer surrounding surface of the pouring tube (2) and wherein the first portion forms a larger proportion of the total outer surface area of the outer surrounding surface of the pouring tube (2) than the second portion.

6. A container according to claim 1, wherein where the outlet spout (6) is of a generally circular cross-section, the pouring tube (2) has a cross-section which is, in part, of a corresponding circular formation such that the radius of curvature of an outer surrounding surface of the pouring tube (2) in the first portion (21) is substantially the same as the radius of curvature of the interior wall of the outlet spout (6).

7. A container according to claim 1, wherein the first end of the pouring tube (2) is joined to a lowermost circumferential surface of the spout (6) by a sealing means which seals the spout (6) from the body region (1).

8. A container according to claim 7, in which the sealing means comprises a ring of material which is arranged to receive the first end (23) of the pouring tube (2) and to provide locating means by which the first end (23) of the pouring tube (2) is located within the spout (6).

9. A container according to claim 1, wherein an upper region of the outlet spout (6) is provided with a top retaining lip (62) for maintaining the pouring tube (2) in position within the outlet spout (6) once inserted.

10. A container according to claim 1, in which the pouring tube (2) may be arranged to extend beyond an uppermost portion of the outlet spout (6) so as to itself form an extension which increases the effective pouring length of the container.

11. A container according to claim 1, wherein spout extension means (7, 7') are provided for increasing an effective length of the pouring tube (2).

12. A container according to claim 11, wherein the spout extension means (7') incorporates an integral air passage (75).

13. A container according to claim 11, wherein the spout extension means (7, 7') further comprises means for threaded connection to the container.

14. A container according to claim 13, wherein the cap (74) includes ventilation means for allowing air to pass directly from the cap (74) into the second passageway.

15. A container according to claim 11, wherein the spout extension means (7, 7') further comprises a cap (74) with which both the extension means (7, 7') and the container cooperate to join the extension means (7, 7') to the container.

16. A container according to claim 15, wherein the cap includes an internal thread formed thereon for cooperation with a corresponding external thread formed on the exterior of the container outlet spout (6).

* * * * *